United States Patent [19]

Aoki et al.

[11] Patent Number: 5,053,305

[45] Date of Patent: Oct. 1, 1991

[54] COMPOSITION AND METHOD FOR DEVELOPING ELECTROSTATIC LATENT IMAGES

[75] Inventors: Kazuo Aoki; Akira Kakinuma; Megumi Saito; Motohiko Makino, all of Akita, Japan

[73] Assignee: TDK Corporation, Tokyo, Japan

[21] Appl. No.: 402,509

[22] Filed: Sep. 5, 1989

[30] Foreign Application Priority Data

Sep. 7, 1988 [JP] Japan ..... 63-223750
Jun. 15, 1989 [JP] Japan ..... 1-152978

[51] Int. Cl.[5] ..... G03G 9/00; G03G 9/083; G03G 5/00; G03G 9/107

[52] U.S. Cl. ..... 430/111; 430/106.6; 430/122; 430/137; 430/110

[58] Field of Search ..... 430/106.6, 110, 122, 430/109, 137, 111

[56] References Cited

U.S. PATENT DOCUMENTS 3,345,294 4/1964 Cooper ..... 430/122
4,640,880 2/1987 Kawanishi et al. ..... 430/106.6
4,797,344 1/1989 Nakahara et al. ..... 430/138

FOREIGN PATENT DOCUMENTS 55-48754 4/1980 Japan .
57-45555 3/1982 Japan .
57-45556 3/1982 Japan .
57-45557 3/1982 Japan .
59-121054 7/1984 Japan .
59-162563 9/1984 Japan .
59-182464 10/1984 Japan .
59-210450 11/1984 Japan .
59-210466 11/1984 Japan .
59-216149 12/1984 Japan .
62-42163 2/1987 Japan .
62-275280 11/1987 Japan .
62-294259 12/1987 Japan .

OTHER PUBLICATIONS

S. F. Pond, Toner Mixture to Reduce Background Transfer Effects, Xerox Disclosure Journal, vol. 2, No. 5, Sep./Oct. '77, p. 17.

*Primary Examiner*—Marion E. McCamish
*Assistant Examiner*—S. C. Crossan
*Attorney, Agent, or Firm*—Oblon, Spivak, McClelland, Maier & Neustadt

[57] ABSTRACT

A composition for developing electrostatic latent images in electrographic printing or copying machinery is provided in which a toner component is blended with 10 to 40% by weight of a carrier. The toner component includes magnetic toner particles each having magnetic powder bound in a resin, and magnetic particles in admixture with the magnetic toner particles, preferably as an external additive in an amount of 0.1 to 10% by weight.

8 Claims, 1 Drawing Sheet

COMPOSITION AND METHOD FOR DEVELOPING ELECTROSTATIC LATENT IMAGES

BACKGROUND OF THE INVENTION

This invention relates to an electrostatic latent image developer comprising a magnetic toner and a carrier and a method for developing an electrostatic latent image using the developer.

For the development of electrostatic latent images, monocomponent developers using magnetic toner are well known in the art. Triboelectric magnetic toners comprising a magnetic toner and a charge control agent are also known as disclosed in Japanese Patent Application Kokai Nos. 48754/1980, 45555/1982, 45556/1982, and 45557/1982. These monocomponent toners suffer from agglomeration due to static charges which causes image defects such as white streaks.

Techniques for preventing such toner agglomeration are disclosed in Japanese Patent Application Kokai Nos. 121054/1984, 182464/1984, 210450/1984, 210466/1984, 216149/1984, 42163/1987, 275280/1987, and 294259/1987. These developing compositions are prepared by adding a carrier to a triboelectric magnetic toner having internally added thereto a charge control agent, for example, a chromium complex of a monoazo dye such as Bontron S-34 (manufactured by Orient Chemical K.K.) and a Nigrosine dye such as Bontron N-01 (manufactured by Orient Chemical K.K.).

Japanese Patent Application Kokai No. 162563/1984 discloses an example in which a developing composition is prepared by adding a carrier to a triboelectric magnetic toner having internally added thereto a charge control agent in the form of Aizen Spilon Black TRH (manufactured by Hodogaya Chemical K.K.) which is a monoazo dye chromium complex. The addition of carrier is effective in eliminating white streaks.

A commonly used developing system of the magnetic brush type includes a magnet and a developing sleeve rotatably mounted thereon. Development is carried out by causing relative rotation of the magnet and the sleeve whereby rotation of the sleeve forms a layer of toner thereon. There is a likelihood that the toner firmly adheres to the sleeve, which is known as sleeve adhesion. Such toner adhesion occurs on the sleeve in a wavy manner, often resulting in a printed image having an undesirable wavy pattern.

SUMMARY OF THE INVENTION

Therefore, an object of the present invention is to provide an improved electrostatic latent image developing composition which is devoid of toner agglomeration, white streak formation, and sleeve adhesion.

Another object of the present invention is to provide a developing method using the electrostatic latent image developing composition.

According to a first aspect of the present invention, there is provided an electrostatic latent image developing composition comprising (A) a toner component comprising magnetic toner particles each containing magnetic powder and a resin, and magnetic particles in admixture with the magnetic toner particles, and (B) carrier particles. Mixing of additional magnetic particles with magnetic toner particles is effective in minimizing adhesion of toner to the sleeve.

According to a second aspect of the present invention, there is provided a method for developing an electrostatic latent image using a developing unit including a magnet, a developing sleeve mounted for relative rotation on the magnet, and a photoconductor disposed in proximity to the sleeve and adapted to have a latent image born thereon. The method includes the steps of: charging the developing unit with an electrostatic latent image developing composition as defined above, and causing relative rotation of the magnet and the developing sleeve, thereby developing the latent image on the photoconductor with the developing composition. Since only the toner is consumed with the progress of development, the toner component is replenished at intervals in the electrostatographic process.

BRIEF DESCRIPTION OF THE DRAWING

The above and other objects, features, and advantages of the present invention will be better understood from the following description taken in conjunction with the accompanying drawing, in which.

the only figure.

DETAILED DESCRIPTION OF THE INVENTION

Figure 1:
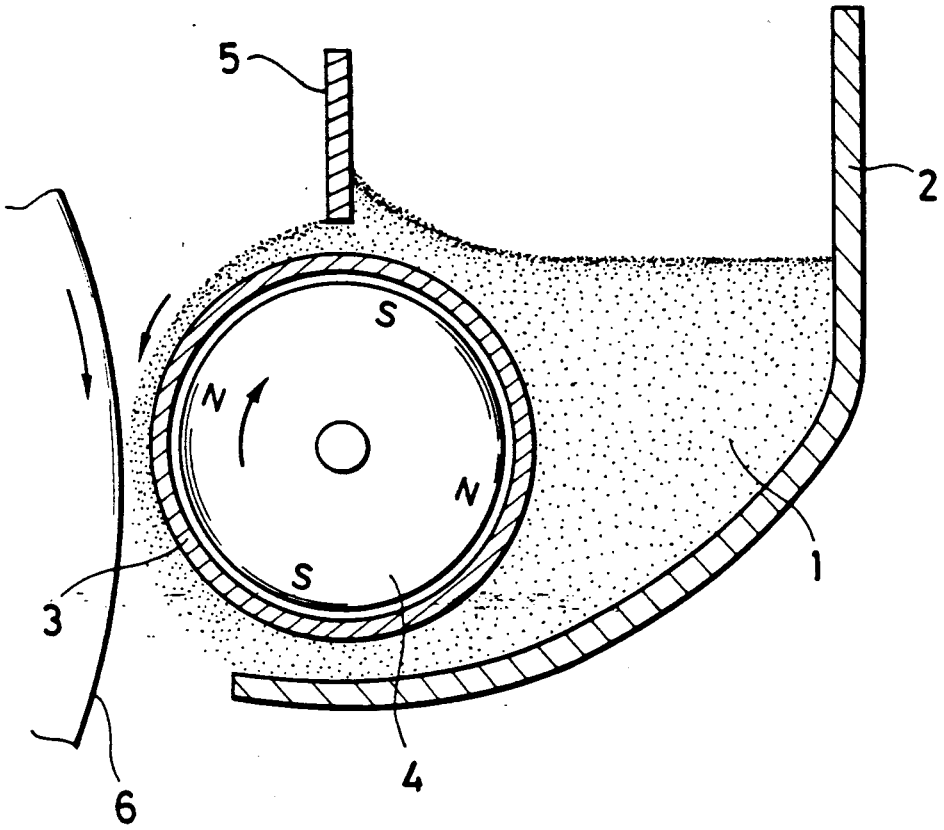
FIG. 1 is a schematic illustration of a developing unit.

The electrostatic latent image developing composition of the invention includes (A) a toner component and (B) a carrier as defined above.

Carrier

The carrier (B) used in the developing composition of the invention is a particulate carrier having a mean particle diameter of from 10 to 45 μm, preferably 10 to 35 μm, more preferably 15 to 30 μm. If the mean particle diameter of the carrier is in excess of 45 μm, resolution would lower and the toner would readily scatter to cause considerable soiling of the developing unit. If the mean particle diameter of the carrier is less than 10 μm, more carrier would be dragged out.

The mean particle diameter used herein is a 50% particle diameter determined upon calculation of volume average particle diameter from measurements by the micro track method. It is calculated from the data obtained by dispersing a particulate sample in water with the aid of a dispersant and carrying out measurement on a volume basis using a micro-track type STD 7991-0 (Leeds & Northrup Co.).

The identity of the carrier is not critical to the invention. The carrier may be formed of various soft magnetic materials such as iron, magnetite and various ferrites. The ferrites used herein may be of various well known compositions include Mg-Cu-Zn ferrite, Ni-Zn ferrite, and Cu-Zn ferrite.

The carrier may have a coating of acrylic resin, silicone resin or fluoride resin, if desired. The carrier may contain a binder such as a polyester resin and styrene acrylic resin like the toner which will be described later.

The carrier may have a coercive force Hc of up to 50 oersted (Oe) upon magnetization at 5000 Oe, preferably up to 20 Oe at 5000 Oe. Carriers with a coercive force of more than 50 Oe would sometimes be unsatisfactory in carrying the toner.

The carrier may have a maximum magnetization $\sigma_m$ of 25 to 220 emu/g, preferably 30 to 210 emu/g upon magnetization at 5000 Oe. Particularly, ferrite carriers preferably have a maximum magnetization $\sigma_m$ of 30 to 100 emu/g. With a maximum magnetization $\sigma_m$ of less than 25 emu/g, carrier drag-out will often occur. If the maximum magnetization $\sigma_m$ of the carrier is more than 220 emu/g, the resulting magnetic brush would form a hard head causing scratches on the photoconductor. It is to be noted that these magnetic properties may be measured by means of a vibration magnetometer.

The carrier may preferably have an electric resistance of at least $1\times10^5\ \Omega$, more preferably $1\times10^6$ to $2\times10^{12}\ \Omega$ upon 100 volt application. With a resistance of lower than $1\times10^5\ \Omega$, more brush streaks would appear. An extremely high resistance is undesirable because a desired density is not readily available. The electric resistance is measured by placing 0.2 grams of the carrier between 7 -mm spaced parallel metal plates which are interposed between opposed magnets. A ultra-insulation resistance tester Model SM-10E or SM-5 (manufactured by Toa Denpa K.K.) is connected to the plates and the voltage applied across the carrier is progressively increased from 10 V to 1000 V. The reading is considered to be an electric resistance.

The carrier may preferably have a bulk density of from 2.1 to 3.3 g/cm$^3$, more preferably from 2.1 to 2.8 g/cm$^3$ as measured according to JIS Z2504.

The carrier may be prepared in various ways. For example, a soft magnetic material is introduced into a mixer, agitated in a slurry state, and then finely divided in an attritor. The material is granulated and dried by means of a spray dryer and classified by a sifter to obtain a fraction of a certain particle size. The material is sintered in an electric furnace, then crushed by a crusher, and disintegrated in a vibratory manner. Then the material is classified by means of a sifter and an air classifier so as to obtain a fraction of a desired particle size. If desired, the resulting particles are further coated by means of a coating machine, heat treated, and classified again, obtaining a coated carrier. Any other well-known methods may be used to prepare the particulate carrier.

Toner

The magnetic toner particles used herein may preferably have a mean particle diameter of from 5 to 25 μm, more preferably from 6 to 25 μm, most preferably from 8 to 20 μm. If the toner particles have a mean particle diameter of less than 5 μm, the developing composition would become less free flowing and tend to cake or adhere to the sleeve. If the toner particles have a mean particle diameter of more than 25 μm, resolution and fixation would deteriorate. The mean particle diameter of the toner particles is a 50% mean particle diameter obtained by calculation of the volume particle diameter from measurements by the Coulter counter method. The Coulter counter method carries out measurement on a volume basis using a Coulter counter Model TA-II having an aperture diameter of 100 μm (manufactured by Coulter Electronics) and Isoton II (manufactured by Coulter Electronics) as the electrolytic solution. As to the particle diameter distribution, it is preferred that the proportion of larger particles having a diameter of at least $2\bar{d}$ is up to about 5% and the proportion of smaller particles having a diameter of up to $\bar{d}2$ is up to about 5% provided that $\bar{d}$ is a mean particle diameter.

The magnetic toner particles each contain magnetic powder and resin.

The magnetic powder may be selected from conventional well-known magnetic materials including metals such as iron, manganese, cobalt, nickel, and chromium, and their alloys, metal oxides such as chromium oxide, iron sesquioxide, and tri-iron tetroxide, and ferrites represented by the general formula: $MO.Fe_2O_3$ wherein M is at least one metal selected from the group consisting of mono. and divalent metals such as Fe, Mn, Co, Ni, Mg, Zn, Cd, Ba, and Li.

The magnetic powder preferably has a mean particle diameter of from 0.01 to 10 μm, more preferably from 0.05 to 3 μm.

In the practice of the invention, the particulate toner preferably contains two or more types of magnetic powder. The two or more types of magnetic powder are preferably those having different coercive forces Hc. For example, a mixture of a first magnetic powder having a lower coercive force Hc of 60 to 150 Oe and a second magnetic powder having a higher coercive force Hc of 130 to 300 Oe at 5000 Oe is preferred. In such a mixture, first and second magnetic powders are preferably blended in a weight ratio of from 1:4 to 4:1, more preferably from 1:2 to 2:1. The mixture preferably has a coercive force Hc of from 80 to 220 Oe at 5000 Oe. Preferably, the average coercive force of the first (higher coercive force) magnetic powder is 100–170 Oe higher than that of the second (lower coercive force) magnetic powder.

The two or more magnetic powders used in admixture may preferably have a maximum magnetization $\sigma_m$ of 50 to 100 emu/g upon magnetization at 5000 Oe.

As a result of mixing of magnetic powders having different properties, the particulate magnetic toner shows magnetic properties as described later and a benefit that an electrostatic latent image is faithfully reproduced at the maximum resolution because of controlled spread of toner to white background around printed sites. Although the reason why a mixture of two or more magnetic powders is effective in controlling toner spread is not understood, such a benefit is not available with a single magnetic powder which has a coercive force corresponding to that of the magnetic powder mixture. With the use of a mixture of two or more magnetic powders, physical toner scattering is controlled so that the developing unit is soiled to a minimum extent.

Each of the two or more magnetic powders used in admixture preferably has a mean particle diameter of from 0.01 to 10 μm, more preferably from 0.05 to 3 μm.

The other component of the toner particles is a resin which is preferably selected from styrene copolymer resins.

The styrene copolymer resins are those obtained by copolymerization of a styrenic monomer and a copolymerizable vinyl monomer. Examples of the copolymerizable monomers include styrene and its derivatives; acrylic and methacrylic esters such as methyl acrylate, ethyl acrylate, isopropyl acrylate, n-butyl acrylate, α-ethylhexyl acrylate, α-hydroxyethyl acrylate, hydroxypropyl acrylate, methyl methacrylate, ethyl methacrylate, isopropyl methacrylate, n-butyl methacrylate, isobutyl methacrylate, n-hexyl methacrylate, lauryl methacrylate, α-hydroxyethyl methacrylate, and hydroxypropyl methacrylate; amides such as acrylamide, diacetone acrylamide, and N-methylol acrylamide; and vinyl esters, ethylenic olefins, and ethylenic unsaturated carboxylic acids.

Polyester resins are also useful. The polyester resins are those obtained by polycondensation of a polybasic acid component and a polyhydric alcohol component. Examples of the polybasic acid include aliphatic, aromatic and cyclo-aliphatic polycarboxylic acids such as oxalic acid, malonic acid, succinic acid, glutaric acid, adipic acid, pimelic acid, suberic acid, azelaic acid, sebacic acid, maleic acid, fumaric acid, phthalic acid, isophthalic acid, terephthalic acid, 1,4-cyclohexane dicarboxylic acid, and 1,3-cyclohexane dicarboxylic acid, and anhydrides thereof.

Examples of the polyhydric alcohol include aliphatic, aromatic and cycloaliphatic polyalcohols such as ethylene glycol, propylene glycol, trimethylene glycol. 1,4-butane diol, 1,5-pentane diol, 1,6-hexane diol, 1,7-heptane diol, 1,8-octane diol, 1,9-nonane diol, 1,10-decane diol, pinacol, hydrobenzoin, benzpinacol, cyclopentane-1,2-diol, cyclo-hexane-1,2-diol, and cyclohexane-1,4-diol.

Other useful resins include epoxy resins, silicone resins, fluoride resins, polyamide resins, acrylic resins, polyurethane resins, polyether resins, polyvinyl alcohol resins, polyethylene, ethylene-vinyl acetate copolymers, and polypropylene.

The resins may be used alone or in admixture of two or more if desired. These resins may be prepared by any of well-known conventional polymerization methods such as solution polymerization, suspension polymerization, emulsion polymerization, mass polymerization, thermal polymerization, interfacial polymerization, high pressure polymerization, and low pressure polymerization, and any appropriate combination thereof.

When the magnetic toner particles are composed of a mixture of the resin and the magnetic powder, each toner particle preferably contains 10 to 70% by weight, more preferably 20 to 60% by weight of the magnetic powder. It will be understood that in each particle, magnetic particles are dispersed and bound in a binder resin in particulate form. If the magnetic powder content of the toner particles is less than 10% by weight, the toner would be insufficient to convey the magnetic forces of the magnets in the developing unit, resulting in aggravated fog and toner scattering. With a magnetic powder content of more than 70% by weight, the toner shows poor fixation.

The magnetic toner particles may further contain various internal additives.

A typical internal additive is a group of waxes. The was is added for the purpose of preventing the so-called offset development as occurring upon fixation with a fixing roll. The wax may be selected from low molecular weight polyethylene and polypropylene, metals salts of fatty acids, and silicone fluids. Illustrative examples are polyethylenes such as Hiwax 100 P and Hiwax 110 P (commercially available from Mitsui Petro-Chemical K.K.), polypropylenes such as Biscol 550 P and Biscol 330 P (commercially available from Sanyo Chemicals K.K.), fatty acid metal salts such as Zinc Stearate 601 and Zinc Stearate CP (commercially available from Nitto Chemicals K.K.), and silicone fluids such as Silicone Oil KF96 and Silicone Oil KF69H (commercially available from Shin-Etsu Silicone K.K.).

A fluoride resin is another useful release agent having a similar function.

The internal additive having a release function may preferably be added in amounts of 0.1 to 10 parts, more preferably 1 to 5 parts by weight per 100 parts by weight of the toner particles.

Other internal additives are tone and resistance control agents, for example, inorganic and organic pigments such as Carbon Black MA-100 (commercially available from Mitsubishi Chemicals K.K.), Kezchen Black EC-600JD (commercially available from Lion Akzo K.K.), 671 Milori Blue (commercially available from Dainichi Seika K.K.), and conductive titanium oxide (commercially available from Titan Industry K.K.). These additives may preferably be added in amounts of 0.1 to 10 parts, more preferably 0.1 to 5 parts by weight per 100 parts by weight of the toner.

Flow and resistance modifiers which will be described later as external additives may also be used as internal additives.

As described above, the toner particles each contain the magnetic powder and the resin and if desired, internal additives such as waxes and pigments. The toner particles may contain charge control agents if desired. It is, however, recommended that charge control agents in the form of metal complexes, especially chromium complexes of azo dyes, especially monoazo dyes and Nigrosine dyes be excluded. This is because there often occur physical toner scattering, background fogging, density lowering, and toner spending if a developer containing a toner having metal complexes of azo dyes and Nigrosine dyes internally added thereto among other charge control agents and a carrier is used in a toner rich condition having an increased initial load of toner component.

The metal complexes of monoazo dyes which should preferably be excluded from the toner of the invention are, for example, of the following structural formula:

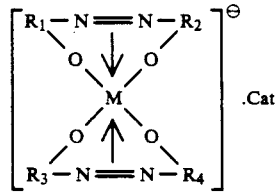

wherein $R_1$, $R_2$, $R_3$ and $R_4$ are independently aromatic polar groups, M is a metal, and Cat is a cation. Other well-known azo dye metal complexes should also preferably be excluded from the toner of the invention.

The Nigrosine dyes which should preferably be excluded from the toner of the invention are well known in the art.

Also dyes of metal complex type should preferably be excluded from the toner of the invention.

Examples of the metal complexes of azo dyes and Nigrosine dyes which should preferably be excluded from the toner of the invention include Aizen Spilon Black TRH, T-37 and T-77 (commercially available from Hodogaya Chemical K.K.), Bontron S-34, S-31, S-32, E-81, E-82, N-01, N-02, N-03, N-04, N-05 and N-07 (commercially available from Orient Chemical K.K.), and Kayaset Black T-2, T-3 and 004 (commercially available from Nihon Kayaku K.K.).

Although the charge control agents other than the metal complexes of azo dyes and Nigrosine dyes, particularly charge control agents in the form of dyes are not as strictly inhibited from internal addition to the toner as the metal complexes of azo dyes and Nigrosine dyes, they should preferably be excluded from the toner of the invention because they have similar tendency. Examples of the charge control agent of dye type which should preferably be excluded from the toner are quaternary ammonium salt dyes such as Bontron P-51 (commercially available from Orient Chemical K.K.) and Kayaset Charge N-1 (commercially available from Nihon Kayaku K.K.).

The toner particles may have externally added thereto resistance modifiers, tone control agents or coloring agents, and flow modifiers.

Examples of the external additive include powder inorganic materials, for example, colloidal silica, metal oxides such as titanium oxide, zinc oxide, and alumina and silicon carbide, calcium carbonate, barium carbonate, and calcium silicate;

bead polymers such as PMMA, polyethylene, nylon, silicon resins, phenol resins, benzoguanamine resins, and polyester;

powder fluoride organic materials such as ethylene tetrafluoride, polytetrafluoroethylene, and fluorinated vinylidene;

metal salts of fatty acids such as zinc stearate and magnesium stearate;

black pigments such as carbon black, acetylene black, channel black, and aniline black;

yellow pigments such as Dialite Yellow GR and Variolyl Yellow 1090;

red pigments such as Permanent Red E5B and Rhodamine 2B;

blue pigments such as copper phthalocyanine and cobalt blue;

green pigments such as Pigment Green B; and orange pigments such as Pyrazolone Orange.

These external additives may be used alone or in admixture of two or more if desired.

It is also possible to externally add release agents as previously described.

These additives may be combined with the toner in various forms. The internal additives may be incorporated in the toner by internally adding the additives to the toner composition. In the event of external addition, the additives may be attached to or near the surface of toner particles as by dry blending, or secured to the surface of toner particles by thermal or mechanical means. The additives may individually take any of such states depending on their type and purpose.

The toner particles and external additives may have been treated with organic or inorganic agents, for example, coupling agents such as titanate, aluminum and silane coupling agents and silicone oil for the purposes of rendering the surface hydrophobic and improving surface dispersibility.

The external additives may preferably have a particle diameter of about 0.01 to about 5 μm. They may be blended in an amount of about 0.1 to about 5% by weight based on the weight of the toner.

It is preferred not to externally add the above-mentioned charge control agents, especially metal complexes of azo dyes and Nigrosine dyes.

According to the feature of the invention, magnetic particles are in admixture with, preferably externally added to the magnetic toner particles. The magnetic particles to be externally added may be selected from the materials previously described for the magnetic powder in the magnetic toner particles.

The additional magnetic particles preferably have a mean particle diameter of 0.01 to 10 μm, more preferably 0.05 to 3 μm. Additional magnetic particles with a mean particle diameter of less than 0.01 μm would fail to prevent sleeve adhesion whereas particles with a mean particle diameter of more than 10 μm adversely affect fixation and tend to undesirably remain in the developer composition. Better results are obtained when the mean particle diameter of the magnetic particles ranges from 0.5% to 20% of that of the magnetic toner particles.

The magnetic particles may preferably have a coercive force Hc of 60 to 250 Oe, more preferably 70 to 220 Oe upon magnetization at 5000 Oe, for example.

In turn, the magnetic powder to be internally added to the magnetic toner particles may preferably have a coercive force Hc of 60 to 250 Oe, more preferably 70 to 220 Oe upon magnetization at 5000 Oe, for example. The ratio of the coercive force of external magnetic particles to that of internal magnetic powder at 5000 Oe may preferably range from ¼ to 4/1 because sleeve adhesion is more effectively prevented.

Preferably, the external magnetic particles and the internal magnetic powder may individually have a maximum magnetization $\sigma_m$ of 60 to 100 emu/g upon magnetization at 5000 Oe because sleeve adhesion is more effectively prevented.

The magnetic particles are externally added to the magnetic toner particles. More particularly, the magnetic particles are dry blended with magnetic toner particles having a larger particle size such that the magnetic particles are adsorbed or attached to the surface of toner particles. Alternatively, the magnetic particles are secured, embedded or integrated to the surface of toner particles by mixing them while imparting mechanical stresses or heat. Besides, simple admixture is also contemplated wherein magnetic particles are blended with magnetic toner particles in a V blender or similar mild blending means.

The magnetic particles are added to the magnetic toner particles in an amount of from 0.1 to 10% by weight, preferably from 1 to 8% by weight based on the weight of the latter. Less than 0.1% by weight of magnetic particles is less effective whereas more than 10% by weight of magnetic particles results in increased fog and reduced fixation.

The magnetic properties of the overall magnetic toner component comprising magnetic toner particles in admixture with magnetic particles are now described.

The toner may preferably have a coercive force Hc of 60 to 250 Oe, more preferably 70 to 220 Oe upon magnetization at 5000 Oe, for example. With a Hc of more than 250 Oe, the toner tends to form a hard head resulting in a lower density.

The toner may preferably have a maximum magnetization $\sigma_m$ of 15 to 60 emu/g upon magnetization at 5000 Oe. With a $\sigma_m$ of more than 60 emu/g, the developing performance and density would lower. The toner would readily scatter at a $\sigma_m$ of less than 15 emu/g.

The toner may preferably have a bulk density of from 0.2 to 0.8 g/cm$^3$, more preferably from 0.4 to 0.7 g/cm$^3$ as measured according to JIS Z2504.

The magnetic toner may be prepared in various ways. One exemplary method involves fully mixing stock materials in a Henschel mixer and then milling in a heat melting mill. The mixture is then cooled down, crushed in a hammer mill, and finely divided in a jet impact mill. An extremely fine fraction is removed by an air classifier, an external additive or additives are dry mixed with the mixture in a Henschel mixer, and an extremely coarse fraction is removed by an air classifier. There is obtained a toner having a predetermined particle diameter distribution. Of course, other well-known prior art methods may be employed.

The carrier and the magnetic toner which are predominant components of the developing composition of the invention have been described. The ratio in maximum magnetization $\sigma_m$ at 5000 Oe of the toner (T) to the carrier (C), that is, $\sigma_{mT}/\sigma_{mC}$ preferably ranges from 0.04 to 2.4, more preferably from 0.08 to 1.7. With a ratio of less than 0.04, it is rather difficult to mix the carrier and the magnetic toner. With a ratio of more than 2.4, a sufficient image density would be achieved with difficulty.

The magnetic toner and the carrier are preferably blended to form a developing composition such that the composition initially contains 10% to 40% by weight of the carrier. If the initial carrier concentration in the developing composition exceeds 40% by weight, then a substantial lowering is found in consistency of image density, fog and resolution upon reproduction of plural copies, especially continuous reproduction of plural copies. If the initial carrier concentration in the developing composition is less than 10% by weight, then the toner tends to agglomerate often resulting in white streaks. Better results are obtained when the initial carrier concentration is in the range of from 12 to 38% by weight, more preferably from 15 to 35% by weight of the developing composition.

Any desired mixer such as a Nauta mixer and V blender may be used to mix the magnetic toner and the carrier.

Method

An electrostatic latent image may be developed with the developing composition described above by the following procedure.

A developing unit is first charged with a predetermined amount of the developing composition containing the carrier in an initial concentration as defined above. The developing unit is preferably of the magnetic brush development type wherein rotation of a magnet magnetically conveys the developing composition to a developing zone.

Preferred developing units are disclosed in Japanese Patent Application Nos. 119935/1979 and 32073/1980, for example, a developing unit comprising a magnet roll and a developing sleeve coaxially enclosing the magnet roll wherein the magnet and the developing sleeve are rotated in the same or opposite directions, and a developing unit comprising a stationary developing sleeve and a rotating magnet roll coaxially received in the sleeve.

FIG. 1 schematically illustrates a developing unit of the magnetic brush development type. The developing unit includes a developing tank 2 for receiving a developing composition 1 therein, a sleeve roll 3, and a magnetic roll 4 coaxially received in the sleeve 3 for free rotation. Relative rotation is induced between the sleeve roll 3 and the magnet roll 4 by rotating either one or both of them. A blade 5 is spaced from the sleeve roll 3 to define a gap between the blade and the sleeve, serving to form a layer of the developing composition on the sleeve roll 3. A photo conductor 6, an arcuate section of which is shown in the figure, is disposed in close facing relationship to the sleeve roll 3. The photoconductor 6 has an electrostatic latent image born thereon. As the photoconductor 6 rotates with respect to the sleeve and magnet rolls 3 and 4 in close relationship, the electrostatic latent image on the photoconductor is developed with the developing composition layer on the sleeve roll.

The benefits of the invention are achieved to the full extent when a developing unit of the magnetic brush type as illustrated above is used.

Besides, the developing composition of the invention is applicable to any other well-known developing systems.

Printing or copying may be commenced once the developing unit is filled with the developing composition. The printing or copying operation consumes only the toner of the composition. Only the toner component is made up at intervals whenever the toner concentration is reduced to a predetermined level in the range of 20 to 60% by weight. A consistent image quality is maintained over a number of sheets printed or copied by replenishing only the toner to the developing unit.

The structure and other features of the photoconductor and the printing or copying machine may be of well-known ones.

EXAMPLE

Examples of the present invention are given below by way of illustration and not by way of limitation. In the examples, pbw is part by weight.

EXAMPLE 1

Preparation of Magnetic Toner

| | |
|---|---|
| Toner composition A | |
| Magnetic powder BL-500 | 55 pbw |
| (Titan Industry K.K.) | |
| mean particle diameter | 0.3 μm |
| Hc @5000 Oe | 75 Oe |
| σm @5000 Oe | 85 emu/g |
| Styrene-acrylic resin | 43.5 pbw |
| (Nihon Carbide Industry K.K.) | |
| Polypropylene 550P | 2.5 pbw |
| (Sanyo Chemicals K.K.) | |
| External additives A1 to A5 | |
| per 100 parts by weight of toner composition A | |
| A1 | |
| Silica R-974 | 0.8 pbw |
| (Nihon Aerogel K.K.) | |
| mean particle diameter 12 mμm | |
| Zinc stearate 601W | 0.1 pbw |
| (Nitto Chemicals K.K.) | |
| mean particle diameter 4 μm after classification | |
| A2 | |
| Silica R-974 | 0.8 pbw |
| Zinc stearate 601W | 0.1 pbw |
| Magnetic particles BL-500 | 2 pbw |
| A3 | |
| Silica R-974 | 0.8 pbw |
| Zinc stearate 601W | 0.1 pbw |
| Magnetic particles BL-500 | 4 pbw |
| A4 | |
| Silica R-974 | 0.8 pbw |
| Zinc stearate 601W | 0.1 pbw |
| Magnetic particles BL-500 | 6 pbw |
| A5 | |
| Silica R-974 | 0.8 pbw |
| Zinc stearate 601W | 0.1 pbw |
| Magnetic particles BL-500 | 15 pbw |
| Toner composition B | |
| Magnetic powder BL-500 | 55 pbw |
| (Titan Industry K.K.) | |
| Styrene-acrylic resin | 41 pbw |
| (Mitsubishi Rayon K.K.) | |
| Polypropylene 550P | 5 pbw |
| (Sanyo Chemicals K.K.) | |
| External additives B1 to B5 | |
| per 100 parts by weight of toner composition B | |
| B1 | |
| Silica R-974 | 0.8 pbw |
| Zinc stearate 601W | 0.1 pbw |
| B2 | |
| Silica R-974 | 0.8 pbw |
| Zinc stearate 601W | 0.1 pbw |
| Magnetic particles, Zn ferrite | 2 pbw |

-continued

| | |
|---|---|
| (TDK Corporation) | |
| mean particle diameter | 0.4 μm |
| Hc @5000 Oe | 140 Oe |
| σm @5000 Oe | 88 emu/g |
| B3 | |
| Silica R-974 | 0.8 pbw |
| Zinc stearate 601W | 0.1 pbw |
| Magnetic particles, Zn ferrite | 4 pbw |
| B4 | |
| Silica R-974 | 0.8 pbw |
| Zinc stearate 601W | 0.1 pbw |
| Magnetic particles, Zn ferrite | 6 pbw |
| B5 | |
| Silica R-974 | 0.8 pbw |
| Zinc stearate 601W | 0.1 pbw |
| Magnetic particles, Zn ferrite | 15 pbw |

The ingredients for each of toner compositions A and B were fully mixed in a Henschel mixer, kneaded in a heat melting mill, cooled down, and crushed in a hammer mill. The mixture was finely divided in a jet impact mill. An extremely fine fraction was removed by an air classifier, obtaining toner particles A and B. A corresponding one of external additives A1-A5 and B1-B5 was dry mixed with each of toner particles A and B in a Henschel mixer, and an extremely coarse fraction is removed by an air classifer. There were obtained toners A1-A5 and B1-B5 all having a predetermined particle diameter distribution. These toners all had a volume average particle diameter of 11 μm. It was found that external additive particles were secured to the surface of toner particles. The physical properties of the toners are shown below.

TABLE 1

Physical Properties of Toners

| | Toner | | | | |
|---|---|---|---|---|---|
| | A1 | A2 | A3 | A4 | A5 |
| Bulk density, g/cm$^3$ | 0.55 | 0.56 | 0.58 | 0.60 | 0.70 |
| σm at 5 kOe, emu/g | 46 | 46 | 48 | 50 | 56 |
| Hc at 5 kOe, Oe | 80 | 80 | 80 | 80 | 80 |
| | B1 | B2 | B3 | B4 | B5 |
| Bulk density, g/cm$^3$ | 0.54 | 0.55 | 0.57 | 0.59 | 0.70 |
| σm at 5 kOe, emu/g | 46 | 46 | 48 | 50 | 56 |
| Hc at 5 kOe, Oe | 80 | 80 | 81 | 82 | 85 |

Particle diameter distribution

Mean particle diameter 11.0 ± 0.5 μm
≦5 μm: up to 0.5%
≧20 μm: up to 0.5%

Preparation of Carrier

Composition (mol%)

Carrier 1: 16NiO—33ZnO—51$Fe_2O_3$
Carrier 2: 10.5 Mg $(OH)_2$—20ZnO—7.5CuO—62$Fe_2O_3$
Carrier 3: 10.5 Mg $(OH)_2$—20ZnO—7.5CuO—62$Fe_2O_3$ The ingredients for each of Carriers 1 to 3 were added to a mixer, agitated in slurry state, and finely divided in an attritor. The mixture was granulated and dried by means of a spray dryer and baked in an electric furnace. There were obtained stock Carriers 1, 2, and 3. The resistance of stock Carriers 2 and 3 was made different by varying the baking conditions.

Using a sifter and an air classifier, stock Carriers 1, 2, and 3 were classified to several fractions having a mean particle diameter as shown below.

| Carrier | Mean Particle Diameter (μm) |
|---|---|
| 1 | 8, 12, 17, 20, 25, 33, 40, 50 |
| 2 | 8, 13, 17, 22, 25, 35, 40, 50 |
| 3 | 9, 13, 16, 20, 25, 35, 41, 50 |

TABLE 2

Physical Properties of Carrier

| Carrier | Magnetization @5000 Oe, emu/g | Resistance @100 V (DC), Ω | Bulk density, g/cm$^3$ | Stock particle size |
|---|---|---|---|---|
| Stock 1 | 40 | $10^8$ | 2.4 | ≦270 mesh |
| Stock 2 | 70 | $10^7$ | 2.3 | ≦270 mesh |
| Stock 3 | 70 | $10^8$ | 2.3 | ≦270 mesh |

For each of Carriers 1, 2, and 3, a fraction having a mean particle diameter of 25 μm was blended with each of Toners A1-A5 and B1-B5 using a V blender. There were obtained developing compositions having an initial carrier concentration of 23% by weight.

A toner image transfer type electrographic printer machine of the reversal type having a photoconductor in the form of an organic photoconductive material (OPC) was charged with each of the developing compositions. The printer includes a developing unit in which a cylindrical developing sleeve is arranged parallel to and spaced a slight gap from a photoconductor drum. A magnet roller adapted to rotate at a high speed is concentrically received in the sleeve for rotation.

The developing sleeve is rotated at a low speed in an opposite direction to the photoconductor drum while the magnet roller within the sleeve is rotated in an opposite direction to the sleeve. A developing bias voltage is applied to the developing sleeve. The developing unit is further provided with an agitator for preventing the toner from agglomerating.

In the developing unit, the developing composition is blended and agitated by the rotation of the developing sleeve so that the toner and the carrier are mutually triboelectrified while the composition is delivered to the circumference of the developing sleeve.

In this printer, electrostatic latent images were developed under the following conditions.

Sleeve roll: 1300×1/7 rpm, diameter 18 mm

Magnet roll: 1300 rpm, 6 poles, surface magnetic flux 700 G

Drum-to-sleeve gap: 0.30 mm

Blade-to-sleeve gap: 0.27 mm

Developing bias voltage: −525 V DC

Surface potential: −640 V (OPC drum)

The printer repeated printing operation while the developing unit was charged with the developing composition containing the toner and the carrier in the initial concentration of 23%. The following properties were examined.

1) Carrier Drag-out

The carrier drag-out was determined by continuously printing a solid black pattern on 3 sheets, counting white spots in the printed image on each sheet, and calculating an average number of white spots.

2) Toner Scattering

Printing operation was continue over 1,000 sheets in an actual printer model. The printer interior was visually observed for toner scattering. The composition was rated OK when the toner did not scatter, but NO when the toner scattered.

Resolution

Groups of lines at 240 and 300 DPI were printed and visually observed through a 10× magnifier to see whether or not respective lines could be identified independent. The toner passed the test when lines could be identified independent. The final evaluation was made as a combined judgment of both the tests.

| Rating | 300 DPI | 240 DPI |
|---|---|---|
| OK | OK | OK |
| Fair | NO | OK |
| NO | NO | NO |

4) Fog

Using a Reflectometer Model TC-6D manufactured by Tokyo Denshoku K.K., the reflectance (Ri) of a plain paper sheet was measured before printing. After a certain pattern was printed on the paper, the reflectance (Rp) of a non. developed area was measured. The fog is equal to Ri minus Rp, that is, the difference in reflectance before and after printing.

5) White streak

The white streak is a partial break in an image or character on a printed sheet. Agglomerated masses or coarse particles of the developing composition clog in the sleeve-to-blade gap, disturb continuous flow of the developing composition, and thus prevent further delivery of the developing composition onto the sleeve, resulting in breaks in images or characters.

The test carried out continuous printing of 1,000 sheets. After an initial image was sampled out, printed images were sampled out every 200 sheets. A 5% printing pattern in which black character areas totaled to 5% of the entire surface area was printed during continuous printing except sampling runs when a specially designed test chart was printed. Evaluation is made according to the following ratings:

OK: No white streak

Fair: White streaks occurred sometimes, but disappeared later.

NO: At least one white streak appeared at all times.

6) Density variation

The density of a printed image was measured using a Reflectometer Model TC-6D manufactured by Tokyo Denshoku K.K. Provided that Di is the density of an initially printed image and Dp is the density of a subsequently printed image, the maximum density difference $\Delta D = Di\text{-}Dp$ was determined.

7) Sleeve adhesion

Continuous printing operation was carried out, the toner was replenished when the toner concentration reached 50% by weight, and further 100 sheets were continuously printed. The sleeve at the surface was blown with air and visually observed to see whether or not agglomerated masses were left on the sleeve. A printed image was also visually observed to see whether or not wavy patterns appeared due to the presence of agglomerated masses. The result was evaluated "NO" when both agglomerated masses and wavy patterns were found, "Fair" when only agglomerated masses were found, and "OK" when neither agglomerated masses nor wavy patterns were found.

8) Fixation

A solid black pattern of 1 by 1 inch was printed on a sheet of plain paper. The resulting solid back image was rubbed with a metallic cylindrical bar (diameter 50 mm and weight 1000 grams) having a piece of gauze attached through double-coated adhesive tape over ten reciprocal strokes. The density of the printed image was measured before and after rubbing.

The percent fixation was calculated according to the following formula:

$$\text{Fixation (\%)} = (Di\text{-}Dr)/Di \times 100$$

wherein Di is a density before rubbing and Dr is a density after rubbing.

Among these tests, fog (4), white streak (5), sleeve adhesion (7), and fixation (8) are reported in Table 3.

TABLE 3

| Toner | External magnetic particles, wt % | Carrier | Sleeve adhesion per 100 prints | White streak per 1000 prints | Fog | Fixation % |
|---|---|---|---|---|---|---|
| A1 | 0 | 1 | NO | OK | ≦0.4 | ≦95 |
| A2 | 2 | 1 | OK | OK | ≦0.4 | ≦95 |
| A3 | 4 | 1 | OK | OK | ≦0.4 | ≦95 |
| A4 | 6 | 1 | OK | OK | ≦0.4 | ≦95 |
| A5 | 15 | 1 | OK | OK | 1.0 | 73 |
| B1 | 0 | 3 | NO | OK | ≦0.4 | ≦95 |
| B2 | 2 | 3 | OK | OK | ≦0.4 | ≦95 |
| B3 | 4 | 3 | OK | OK | ≦0.4 | ≦95 |
| B4 | 6 | 3 | OK | OK | ≦0.4 | ≦95 |
| B5 | 15 | 3 | OK | OK | 1.2 | 75 |

As is apparent from the results of Table 3, external addition of 0.1 to 10% by weight of magnetic particles to magnetic toner particles prevents the toner from adhering to the sleeve and improves fixation and fog.

EXAMPLE 2

A similar experiment was carried out as in Example 1 using toners A3 and B3 and carrier fractions 1 and 2 having a mean particle diameter of 25 μm in Example 1 except that the initial carrier concentration of the developing composition was varied.

Table 4 shows the results of (5) white streak and (6) image density variation during continuous printing of 1,000 sheets.

TABLE 4-1

| Carrier content, wt % | Carrier 1 — Tests per 1000 prints: White streak | | Density variation | |
|---|---|---|---|---|
| | Toner A3 | Toner B3 | Toner A3 | Toner B3 |
| 8 | NO | NO | ≦0.1 | ≦0.1 |
| 12 | Fair | OK | ≦0.1 | ≦0.1 |
| 18 | OK | OK | ≦0.1 | ≦0.1 |
| 23 | OK | OK | ≦0.1 | ≦0.1 |
| 30 | OK | OK | ≦0.1 | ≦0.1 |
| 35 | OK | OK | ≦0.1 | ≦0.1 |
| 45 | OK | OK | 0.18 | 0.17 |
| 50 | OK | OK | 0.23 | 0.21 |

TABLE 4-2

| Carrier content, wt % | Carrier 2 — Tests per 1000 prints: White streak | | Density variation | |
|---|---|---|---|---|
| | Toner A3 | Toner B3 | Toner A3 | Toner B3 |
| 8 | NO | NO | ≦0.1 | ≦0.1 |
| 12 | Fair | OK | ≦0.1 | ≦0.1 |
| 18 | OK | OK | ≦0.1 | ≦0.1 |
| 23 | OK | OK | ≦0.1 | ≦0.1 |
| 30 | OK | OK | ≦0.1 | ≦0.1 |
| 35 | OK | OK | ≦0.1 | ≦0.1 |
| 50 | OK | OK | 0.20 | 0.19 |

For all the combinations of Carriers 1 and 2 with Toners A3 and B3, when the initial carrier concentration is less than 10% by weight, there appear white streaks due to toner agglomeration which is to be eliminated by the present invention. In turn, if the initial carrier concentration is higher than 40% by weight, the toner is not readily distributed over the carrier when it is replenished as necessitated during continuous printing. As a consequence, a problem arises with respect to the stability of image density. For this reason, the initial proportion of the carrier in the developing composition should range from 10% to 40% by weight.

EXAMPLE 3

A similar experiment was carried out using carrier fractions having different mean particle diameters. The results are shown in Table 5. The initial carrier concentration was set at 23% by weight of the composition.

TABLE 5-1

| Carrier fraction, mean dia. (μm) | Carrier drag-out Toner A2 | Carrier drag-out Toner B2 | Toner scattering Toner A2 | Toner scattering Toner B2 | Resolution Toner A2 | Resolution Toner B2 |
|---|---|---|---|---|---|---|
| | Carrier 1 | | | | | |
| 8 | 9 | 9 | OK | OK | OK | OK |
| 12 | 0 | 0 | OK | OK | OK | OK |
| 17 | 0 | 0 | OK | OK | OK | OK |
| 20 | 0 | 0 | OK | OK | OK | OK |
| 25 | 0 | 0 | OK | OK | OK | OK |
| 33 | 0 | 0 | OK | OK | Fair | OK |
| 50 | 0 | 0 | NO | NO | NO | NO |

TABLE 5-2

| Carrier fraction, mean dia. (μm) | Carrier drag-out Toner A2 | Carrier drag-out Toner B2 | Toner scattering Toner A2 | Toner scattering Toner B2 | Resolution Toner A2 | Resolution Toner B2 |
|---|---|---|---|---|---|---|
| | Carrier 3 | | | | | |
| 9 | 5 | 5 | OK | OK | OK | OK |
| 13 | 0 | 0 | OK | OK | OK | OK |
| 16 | 0 | 0 | OK | OK | OK | OK |
| 20 | 0 | 0 | OK | OK | OK | OK |
| 25 | 0 | 0 | OK | OK | OK | OK |
| 35 | 0 | 0 | OK | OK | OK | OK |
| 50 | 0 | 0 | NO | NO | NO | NO |

For all the combinations of Carriers 1 and 3 with Toners A2 and B2, when the mean particle diameter of the carrier is less than 10 μm, there appear substantial carrier drag-outs. In turn, if the mean particle diameter of the carrier is more than 45 μm, resolution is deteriorated and the machine is soiled with scattering toner.

EXAMPLE 4

A 5% printing pattern was continuously printed on 10,000 sheets of plain paper by charging the printing machine with an initial developing composition consisting of 100 grams of a toner and 30 grams of a carrier having a mean particle diameter of 25 μm, and replenishing 100 grams of the toner whenever a toner indicator was lighted. The toner indicator was adapted to be lighted when the toner concentration reached 50% by weight. The results are shown in Table 6.

The developing compositions used contained a carrier and a toner in the following combinations.

| Developing Composition | |
|---|---|
| Developer 1 | Carrier 1 × Toner A3 |
| Developer 2 | Carrier 1 × Toner B3 |
| Developer 3 | Carrier 3 × Toner A3 |
| Developer 4 | Carrier 3 × Toner B3 |
| Developer 5 | Carrier 1 × Toner C3 |
| Developer 6 | Carrier 1 × Toner D3 |

Carriers 1 and 3 and Toners A3 and B3 are the same as in Example 1. Toners C3 and D3 are the same as Toners A3 and B3 except that toner compositions A and B were replaced by the following toner compositions C and D, respectively.

| | |
|---|---|
| Toner composition C | |
| Magnetic powder BL-500 (Titan Industry K.K.) | 55 pbw |
| Styrene-acrylic resin (Nihon Carbide Industry K.K.) | 42.5 pbw |
| Polypropylene 550P (Sanyo Chemicals K.K.) | 2.5 pbw |
| Aizen Spilon Black TRH (Hodogaya Chemical K.K.) | 1 pbw |
| Toner composition D | |
| Magnetic powder BL-500 (Titan Industry K.K.) | 55 pbw |
| Styrene-acrylic resin (Mitsubishi Rayon K.K.) | 40 pbw |
| Polypropylene 550P (Sanyo Chemicals K.K.) | 5 pbw |
| Bontron S-34 (Orient Chemical K.K.) | 1 pbw |

TABLE 6

| Developer | Initial Image density | At the end of 10,000 sheet printing: Image density variation | Fog |
|---|---|---|---|
| 1 | 1.43 | 0.10 | <0.4 |
| 2 | 1.39 | 0.09 | <0.4 |
| 3 | 1.40 | 0.10 | <0.4 |
| 4 | 1.36 | 0.08 | <0.4 |
| 5 | 1.40 | 0.20 | 0.6 |
| 6 | 1.41 | 0.18 | 0.6 |

It is seen for the combinations of Carriers 1 and 3 with Toners A3 and B3 that the pattern can be consistently reproduced at the end of 10,000 sheet printing without any deterioration of the carrier or any adverse effect on the photoconductor by the developing composition.

In the case of Developers 5 and 6 which were prepared by internally adding charge control agents, Aizen Spilon Black TRH and Bontron S-34, which are monoazo dye chromium complexes, to Toners A3 and B3 and blending the toner and the carrier in a carrier concentration of 10 to 40% by weight, the tested properties were poor, especially the machine interior was severely soiled and the background fogging was increased.

EXAMPLE 5

Preparation of Magnetic Toner

Toner compositions I to XI as shown in Table 7 were prepared from a magnetic powder, a styrene acrylic resin (Nihon Carbide Industry K.K.) and polypropylene 550P (Sanyo Chemicals K.K.). Three types of magnetic powder were used:

Magnetic powder A of magnetite having a mean particle diameter of 0.3 μm, a coe ·ive force Hc of 80

Oe and a maximum magnetization $\sigma_m$ of 85 emu/g at 5,000 Oe;

Magnetic powder B of magnetite having a mean particle diameter of 0.5 μm, a Hc of 220 Oe and a $\sigma_m$ emu/g at 5,000 Oe; and Magnetic powder C of magnetite having a mean particle diameter of 0.2 μm, a Hc of 140 Oe and a $\sigma_m$ emu/g at 5,000 Oe.

TABLE 7

| Composition (parts by weight) | | | | | |
|---|---|---|---|---|---|
| | Magnetic Powder | | | Styrene- | |
| Toner | A | B | C | acryl | PP |
| I | 55 | — | — | 43.5 | 2.5 |
| II | 41.25 | 13.75 | — | 43.5 | 2.5 |
| III | 27.5 | 27.5 | — | 43.5 | 2.5 |
| IV | 13.75 | 41.25 | — | 43.5 | 2.5 |
| V | — | 55 | — | 43.5 | 2.5 |
| VI | 55 | — | — | 41 | 5 |
| VII | 41.25 | 13.75 | — | 41 | 5 |
| VIII | 27.5 | 27.5 | — | 41 | 5 |
| IX | 13.75 | 41.25 | — | 41 | 5 |
| X | — | 55 | — | 41 | 5 |
| XI | — | — | 55 | 43.5 | 2.5 |
| External additives* | | | | | |
| Silica R-974 | | | | 0.8 pbw | |
| Zinc stearate 601W | | | | 0.1 pbw | |
| Magnetic particles, BL-500 | | | | 6 pbw | |

*per 100 parts by weight of the toner

The ingredients for each of compositions I through XI were fully mixed in a Henschel mixer, kneaded in a heat melting mill, cooled down, and crushed in a hammer mill. The mixture was finely divided in a jet impact mill. An extremely fine fraction was removed by an air classifer, the external additives were dry mixed with the mixture in a Henschel mixer, and an extremely coarse fraction is removed by an air classifier. There was obtained a toner having a predetermined particle diameter distribution. Toners I through XI all had a volume average particle diameter of 11 μm. Their physical properties are shown in Table 8.

TABLE 8

| Toner | Bulk density (g/cm$^3$) | Magnetization @5 kOe (emu/g) | Coercive force @5 kOe (Oe) |
|---|---|---|---|
| I | 0.60 | 50 | 80 |
| II | 0.59 | 50 | 120 |
| III | 0.59 | 50 | 145 |
| IV | 0.59 | 50 | 180 |
| V | 0.59 | 50 | 220 |
| VI | 0.59 | 50 | 80 |
| VII | 0.58 | 50 | 120 |
| VIII | 0.58 | 50 | 145 |
| IX | 0.58 | 50 | 180 |
| X | 0.58 | 50 | 220 |
| XI | 0.60 | 49 | 140 |
| Particle diameter distribution | | | |
| Mean particle diameter | | 11.0 ± 0.5 μm | |
| | | ≦5 μm: up to 0.5% | |
| | | ≧20 μm: up to 0.5% | |

For each of Carriers 1 and 3 prepared in Example 1, a fraction having a mean particle diameter of 25 μm was blended with each of Toners I through XI using a V blender. There were obtained developing compositions having an initial carrier concentration of 23% by weight.

The printer used in Example 1 having a photoconductor in the form of an organic photoconductive material (OPC) was charged with each of the developing compositions.

The printer repeated printing operation while the developing unit was initially charged with the developing composition containing the toner and the carrier. Tests were carried out to examine toner scattering in the same manner as in Example 1 and line reproduction in the following manner.

Line reproduction

A 1-dot line pattern was printed using a printer having a resolution of 300 DPI. The width W (in μm) of the printed line was measured by taking an enlarged photograph. The ratio of the measured width W to the calculated line width of 85 μm was determined. Whether or not a latent image was faithfully reproduced after fixation was evaluated according to the following ratings.

OK: W/85=0.95–1.10

Fair: W/85=0.85–0.95 or 1.10–1.20

NO: W/85=less than 0.85 or more than 1.20

The results are shown in Table 9.

TABLE 9

| Toner | Toner scattering | Line reproduction |
|---|---|---|
| I | OK | NO |
| II | OK | OK |
| III | OK | OK |
| IV | OK | OK |
| V | NO | OK |
| VI | OK | NO |
| VII | OK | OK |
| VIII | OK | OK |
| IX | OK | OK |
| X | NO | OK |
| XI | OK | NO |

The data of Table 9 shows the effectiveness of a mixture of two types of magnetic powder. More particularly, the single use of Magnetic Powder A having a low Hc caused the toner to spread to the white background near characters and resulted in reduced line reproduction, and the single use of Magnetic Powder B having a high Hc caused toner scattering in the printer interior. In contrast, both line reproduction and toner scattering control were improved by using a mixture of Magnetic Powders A and B. These improvements are quite unexpected in light of the fact that the single use of Magnetic Powder C having an intermediate Hc between Magnetic Powders A and B resulted in reduced line reproduction.

It is to be noted that the developing compositions falling within the scope of the invention were evaluated OK with respect to the resolution of 240 and 300 DPI lines.

Although the foregoing examples refer to negative charge toners, equivalent results are obtained with positive charge toners. In the case of positive charge toners, unsatisfactory results were obtained with a developer having internally added a Nigrosine dye, for example, Bontron N-01 (Hodogaya Chemical K.K.) as the charge control agent.

According to the present invention, images can be printed on a multiplicity of serially fed sheets with a minimal change of quality including density, fog, and resolution. The developing composition of the invention can prevent toner agglomeration, while streak formation, and sleeve adhesion.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. An electrostatic latent image developing composition, comprising:

(A) a toner component comprising magnetic toner particles having a mean particle diameter of from 5 to 25 μm and each formed from magnetic powder and a resin, and externally added magnetic particles having a mean particle diameter of from 0.01 to 10 μm in an amount of 0.1 to 10% by wt of the magnetic toner particles, which are in admixture with the magnetic toner particles; and (B) from 10 to 40% by wt, based on the weight of the composition of soft magnetic carrier particles which have a mean particle diameter of from 10 to 45 μm.

2. The developing composition of claim 1 wherein said magnetic toner particles each comprise at least two types of magnetic powder.

3. A method for developing an electrostatic latent image using a developing unit including a magnet, a developing sleeve mounted for relative rotation on the magnet, and a photoconductor disposed in proximity to the sleeve and adapted to have a latent image born thereon, comprising the steps of:

charging the developing unit with an electrostatic latent image developing composition as set forth in claim 1, and causing relative rotation of the magnet and the developing sleeve, thereby developing the latent image on the photoconductor with the developing composition.

4. The method of claim 3 which further includes replenishing only the toner component.

5. The developing composition of claim 1, wherein toner component (A) further contains a non-magnetic external additive.

6. The developing composition of claim 5, wherein the external additive has a particle size of 0.01 to 5 μm.

7. The developing composition of claim 5 or 6, wherein the external additive is present in an amount of 0.1 to 5% by weight based on the toner component.

8. An electrostatic latent image developing composition, comprising:

(A) a toner composition comprising magnetic toner particles having a mean particle diameter of from 5 to 25 μm and each formed from magnetic powder and a resin, and externally added magnetic particles having a mean particle diameter of from 0.01 to 10 μm in an amount of 0.1 to 10% by wt of the magnetic toner particles and 0.1 to 5% by wt of externally added non-magnetic particles having a particle size of 0.01 to 5 μm, which are in admixture with the magnetic toner particles; and (B) from 10 to 40% by wt, based on the weight of the composition, of soft magnetic carrier particles which have a mean particle diameter of from 10 to 45 μm.

* * * * *